US008646800B2

(12) United States Patent
Bertagnolio et al.

(10) Patent No.: US 8,646,800 B2
(45) Date of Patent: Feb. 11, 2014

(54) DEVICE FOR BRAKING A BOARD FOR GLIDING

(75) Inventors: Denis Bertagnolio, Coublevie (FR); Jean-Marc Pascal, Voreppe (FR); Olivier Bizzini, Saint Egreve (FR)

(73) Assignee: Skis Rossignol, Saint-Jean-de Moirans (FR)

( * ) Notice: Subject to any disclaimer, the term of this patent is extended or adjusted under 35 U.S.C. 154(b) by 227 days.

(21) Appl. No.: 12/947,951

(22) Filed: Nov. 17, 2010

(65) Prior Publication Data

US 2011/0115197 A1 May 19, 2011

(30) Foreign Application Priority Data

Nov. 17, 2009 (FR) ..... 09 58118

(51) Int. Cl.
*A63C 5/06* (2006.01)

(52) U.S. Cl.
USPC ..... 280/605; 280/634

(58) Field of Classification Search
USPC ..... 280/604, 605, 28.11, 619, 621, 632, 280/11.211, 11.215, 11.216, 634; 188/8
See application file for complete search history.

(56) References Cited

U.S. PATENT DOCUMENTS

| | | | | | |
|---|---|---|---|---|---|
| 3,918,730 | A * | 11/1975 | Schultes | ..... | 280/605 |
| 3,930,659 | A * | 1/1976 | Salomon | ..... | 280/605 |
| 4,039,204 | A * | 8/1977 | Frey | ..... | 280/605 |
| 4,066,276 | A * | 1/1978 | Salomon | ..... | 280/605 |
| 4,498,685 | A * | 2/1985 | Zoor | ..... | 280/605 |
| 5,207,438 | A * | 5/1993 | Landers | ..... | 280/11.206 |
| 6,053,511 | A * | 4/2000 | Intengan | ..... | 280/11.216 |
| 2004/0041366 | A1 * | 3/2004 | Dandurand | ..... | 280/631 |
| 2007/0075524 | A1 | 4/2007 | Kelly | | |

FOREIGN PATENT DOCUMENTS

| | | | | |
|---|---|---|---|---|
| DE | 3433504 | A1 * | 3/1986 | ..... A63C 7/10 |
| FR | 2508805 | | 1/1983 | |
| FR | 2838977 | A | 10/2003 | |
| WO | WO 03/092829 | A | 11/2003 | |
| WO | WO 2009/075837 | A | 6/2009 | |

OTHER PUBLICATIONS

Search Report issued by French Patent Office on Aug. 4, 2010 for priority application FR 09 58118.

* cited by examiner

*Primary Examiner* — J. Allen Shriver, II
*Assistant Examiner* — Bridget Avery
(74) *Attorney, Agent, or Firm* — Frommer Lawrence & Haug LLP; Ronald R. Santucci

(57) ABSTRACT

A braking device for a board for gliding, includes a brake movable between a first, braking position, in which the brake occupies a low position wherein the brake is in frictional contact with the ground, and a second, non-braking position, in which the brake occupies a raised position, and a brake control device connecting the brake with a strap of a boot binding on the board for gliding, such that the brake control device causes the brake to move to the non-braking position upon closing and/or tightening of a strap of the boot binding.

15 Claims, 9 Drawing Sheets

Prior Art

FIG.8
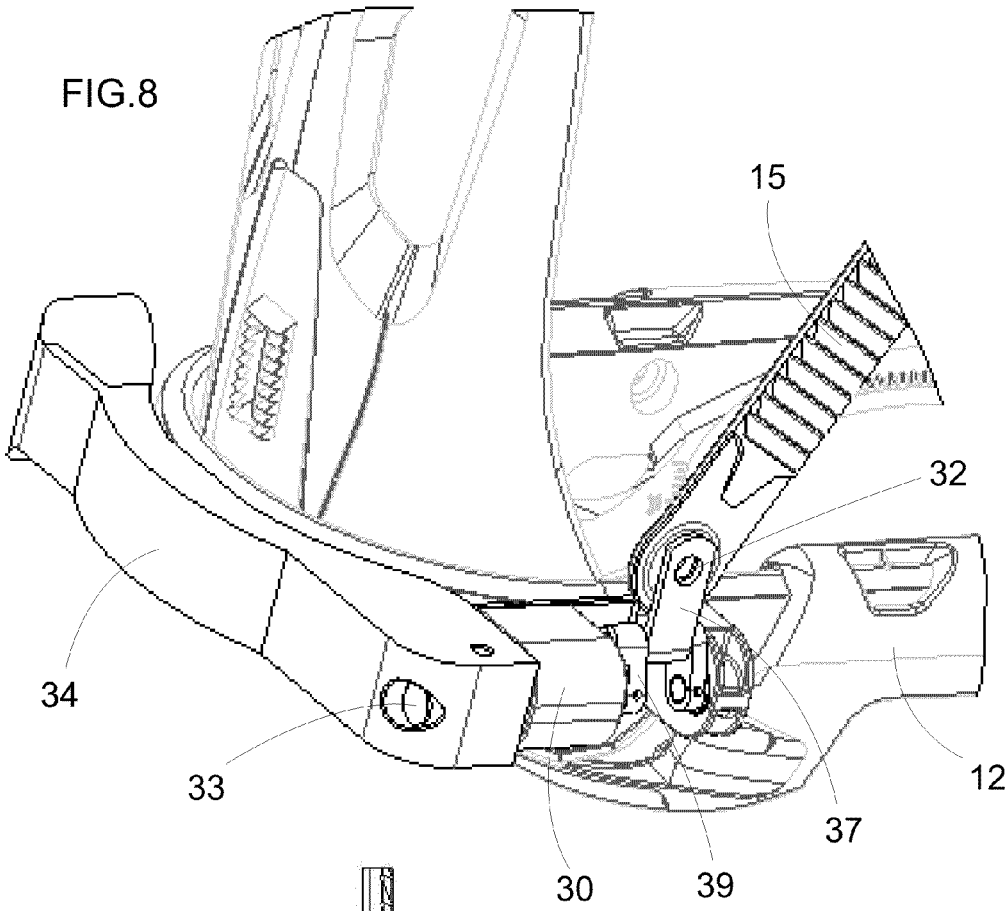
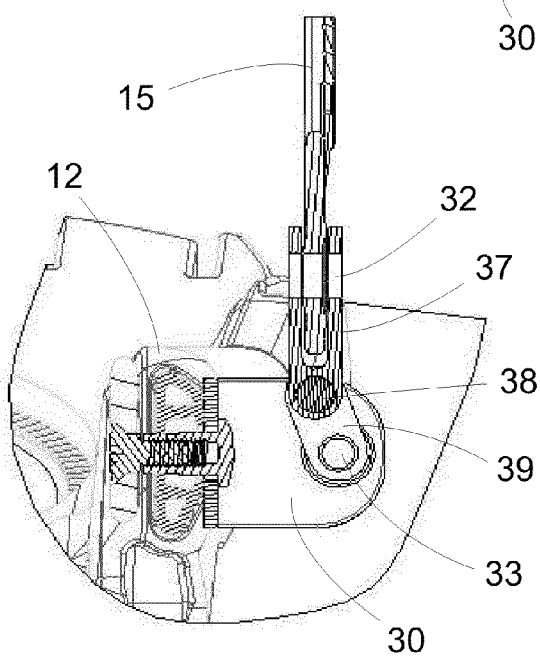
FIG.9

FIG.10
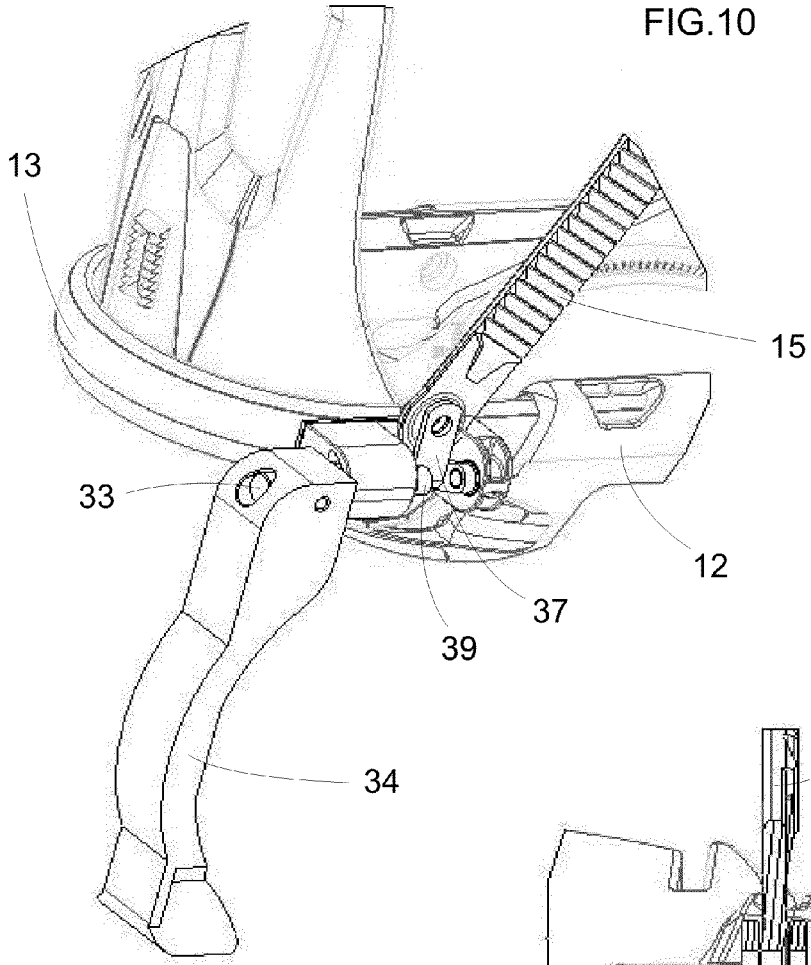
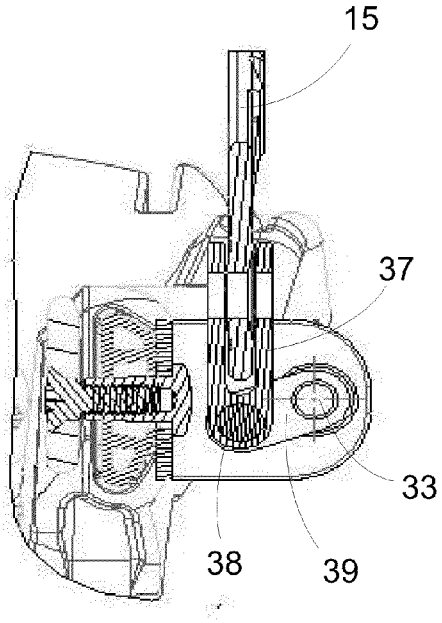
FIG.11

DEVICE FOR BRAKING A BOARD FOR GLIDING

This application claims priority benefits to French Patent Application Number 09 58118 filed Nov. 17, 2009, the entire disclosure of which is herein incorporated by reference.

FIELD OF THE INVENTION

The invention relates to a braking device for a board for gliding, particularly adapted for mounting on a snowboard. The invention also relates to a device for fastening a boot, called boot binding, on a board for gliding and to a board for gliding as such comprising such a braking device.

BACKGROUND OF THE INVENTION

A prior art snowboard binding is described in document FR2838977 and illustrated in FIG. 1. It comprises two lateral wings 2 fastened onto a base part 1. A rear bail or cradle 3, associated with a rear support element 4, also called a "spoiler", is mounted on these wings 2 and extends over the rear of the device. In order to fasten his or her boot in the binding, the user positions his or her boot on the base part 1, between the two lateral wings 2, the boot abutting against the rear bail 3 and the spoiler 4. The operation of fastening the boot in the binding is finished by fastening the boot using one or more straps, over the instep and over the front of the boot. Each fastening strap is in fact composed of two parts 5, 6 fastened, respectively, on the opposite lateral wings, that will also be simply called a "strap", which are fastened together using an adjustable fastening mechanism that makes it possible optimally to match the contour of the boot in the position where the boot is fastened into the binding in order to guarantee satisfactory holding of the boot. To that end, a first strap 5 in general comprises a toothed zone that interacts with a tightening buckle 7 arranged on a second strap 6. This solution has the drawback of having no braking device and of not being entirely secured. Thus, a snowboard equipped with such a binding presents the risk of starting off alone, sliding down a snowy slope, which is highly dangerous.

In order to offset this drawback, document WO2009/075837 describes a device for fastening a boot on a snowboard that comprises the conventional elements referred to above, plus a braking device, which relies on a pedal positioned on the base part of the device. This pedal is connected to a brake so as, when the boot is fastened into the binding, the boot bearing on the pedal, to give rise to the movement of the brake from its braking position into a raised, non-braking position. Conversely, when the boot is raised on the base part, the brake automatically resumes its braking configuration, in which it comes into contact with the snow.

Document US2007/0075524 describes a different braking device mounted on a snowboard. This device is independent of the boot binding, and comprises its own base part fixed to the snowboard, on which a brake is mounted so as to be movable in rotation. One embodiment connects this brake to a fastening strap so that the brake can automatically be set in movement toward its braking position whenever the fastening strap for the boot is released, in a phase when the boot is released from the snowboard binding. This solution has the first drawback of requiring manual actuation of the brake in order to place it back into its non-braking position, before it is possible to begin riding. Furthermore, this independent solution has the second drawback of involving significant additional bulky hardware on the upper face of the snowboard.

SUMMARY OF THE INVENTION

A general object of the present invention is thus to propose a braking solution adapted to a snowboard that does not have all or some of the drawbacks of existing solutions.

More precisely, a first object of the present invention consists in proposing a braking solution adapted to a snowboard that is compatible with existing devices for fastening a boot onto a snowboard.

A second object of the present invention consists in proposing a braking solution adapted to a snowboard that is secure, user-friendly and involves little extra hardware.

To that end, the invention relies on a braking device for a board for gliding, comprising a brake that can occupy a first, braking position, in which it occupies a low position capable of entering into friction with the ground, and a second, non-braking position, in which it occupies a raised position, and comprising a means for controlling the position of the brake, wherein the means for controlling the position of the brake comprises a link means adapted for a link with a strap of a boot binding on a board for gliding, such that the means for controlling the brake lead to the automatic positioning, in the non-braking position, of the brake upon closing and/or tightening of a strap on a boot.

According to a first embodiment, the means for controlling the brake may comprise a rocker that can move in rotation, the rocker comprising a link with the brake and a link means adapted for a link with a strap of a boot binding on a board for gliding.

According to a second embodiment, the control means may comprise at least one connecting rod, one end of which is adapted for a link with a strap of a boot binding on the board for gliding and another end of which is linked to a rotation pin of the brake.

According to a third embodiment, the control means may comprise a cable, one end of which is linked to the brake and another end of which is suitable for a link with a strap of a boot binding on the board for gliding.

The brake may be mounted in rotation about a pin mounted in rotation on a base piece, and an end of the cable may be linked to a wheel integral with the rotation pin.

An end of the cable may be linked to a plate that can move in translation, which comprises a means for linking with a strap.

The control means is provided so that a force exerted on the link means adapted for a link with a strap of a boot binding on a board for gliding of the means for controlling the brake leads to the automatic positioning, in the non-braking position, of the brake.

The invention also relates to a sports boot binding on a board for gliding, which comprises a braking device as above.

The means for controlling the position of the brake of the braking device may be linked to a boot-fastening strap of the boot binding on the board for gliding, such that the means for controlling the brake leads to the automatic positioning, in the non-braking position, of the brake upon closure and tightening of the strap on a boot and, conversely, the automatic positioning, in the braking position, of the brake upon opening of the strap for release of the boot through the force of a return spring.

The sports boot binding on a board for gliding may comprise a rocker mounted in rotation on a lateral part of the boot binding about a pin, the end of a boot-fastening strap being mounted on the rocker by a second pin positioned behind the rotation pin of the rocker.

In the configuration when the boot is fastened into the binding, the brake may occupy a position substantially parallel to the bail or wing or the brake may be substantially parallel to a lateral side of a rear support element.

The brake may be mounted securely on the rocker and is thus movable in rotation about a transverse pin relative to the boot binding.

The sports boot binding may comprise a connecting rod, a first end of which is linked to a fastening strap and a second end of which is linked to a rotation pin of the brake, this pin being mounted so as to be movable in rotation within a base piece in a substantially longitudinal direction.

The brake may be driven in a rotational movement of substantially a quarter turn relative to the base piece of the boot binding.

The sports boot binding may comprise a cable connected, on the one hand, to a rotation pin of a brake mounted in rotation on a base piece, and, on the other, to a plate linked to the end of a boot-fastening strap and movable in translation relative to the base piece of the boot binding.

The invention also relates to a board for gliding, which comprises a braking device as described above.

DESCRIPTION OF THE DRAWINGS

These objects, characteristics and advantages of the present invention will be set forth in detail in the following description of particular embodiments given by way of non-limiting example in connection with the appended figures, in which:

FIG. 8 shows a perspective view of the boot binding on a snowboard, comprising a braking device in the non-braking position, according to the second embodiment of the invention.

FIG. 9 shows a perspective view, in section through the braking device, of the braking device in the non-braking position, according to the second embodiment of the invention.

FIG. 10 shows a perspective view of the boot binding on a snowboard, comprising a braking device in the braking position, according to the second embodiment of the invention.

FIG. 11 shows a perspective view, in section through the braking device, of the braking device in the braking position, according to the second embodiment of the invention.

DESCRIPTION OF THE EMBODIMENT

The various figures illustrate different embodiments of the invention, in which the same references will be used for the same elements. Furthermore, to make it easier to understand the description, the longitudinal, horizontal direction will be called x, as defined by the base part of a boot binding, in the direction from rear to front—the transverse, horizontal direction will be called y, direction perpendicular to the previous direction, and the vertical, upward-oriented direction will be called z, such direction being perpendicular to the preceding two directions.

Figure 1:
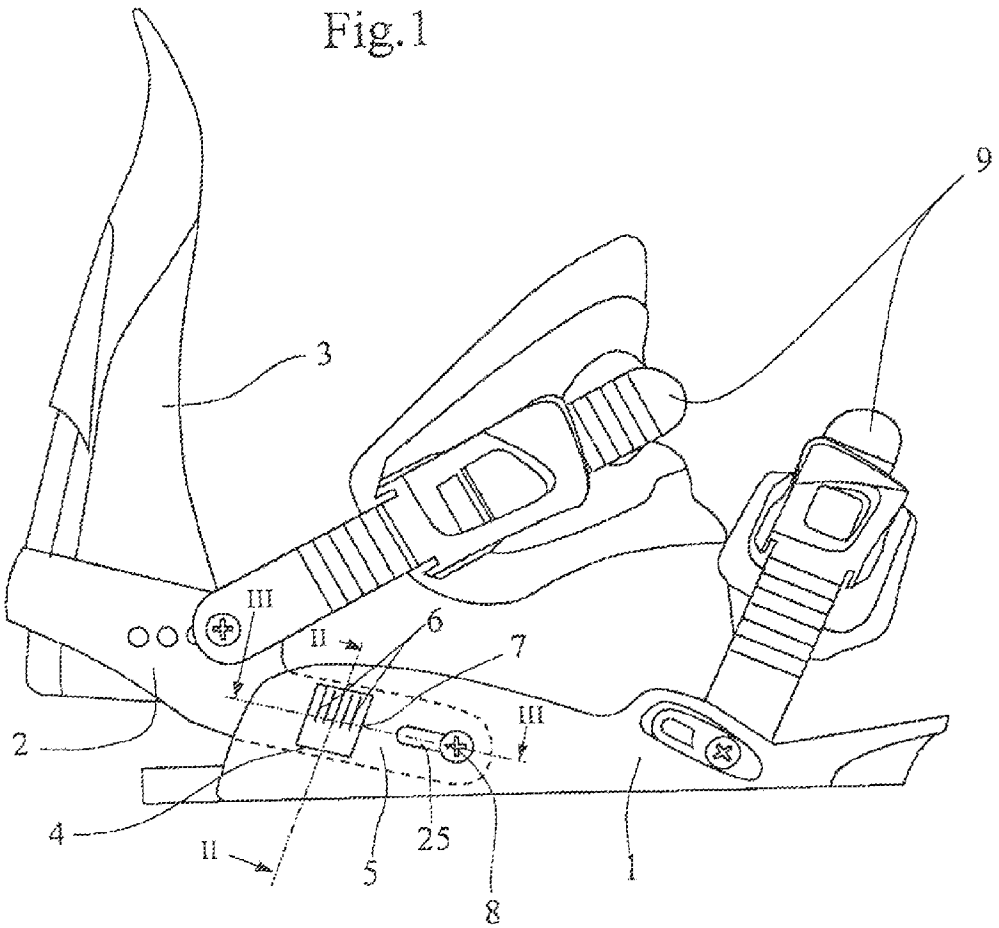
FIG. 1 shows a side view of a boot binding on a snowboard, according to a prior art.
Figure 2:
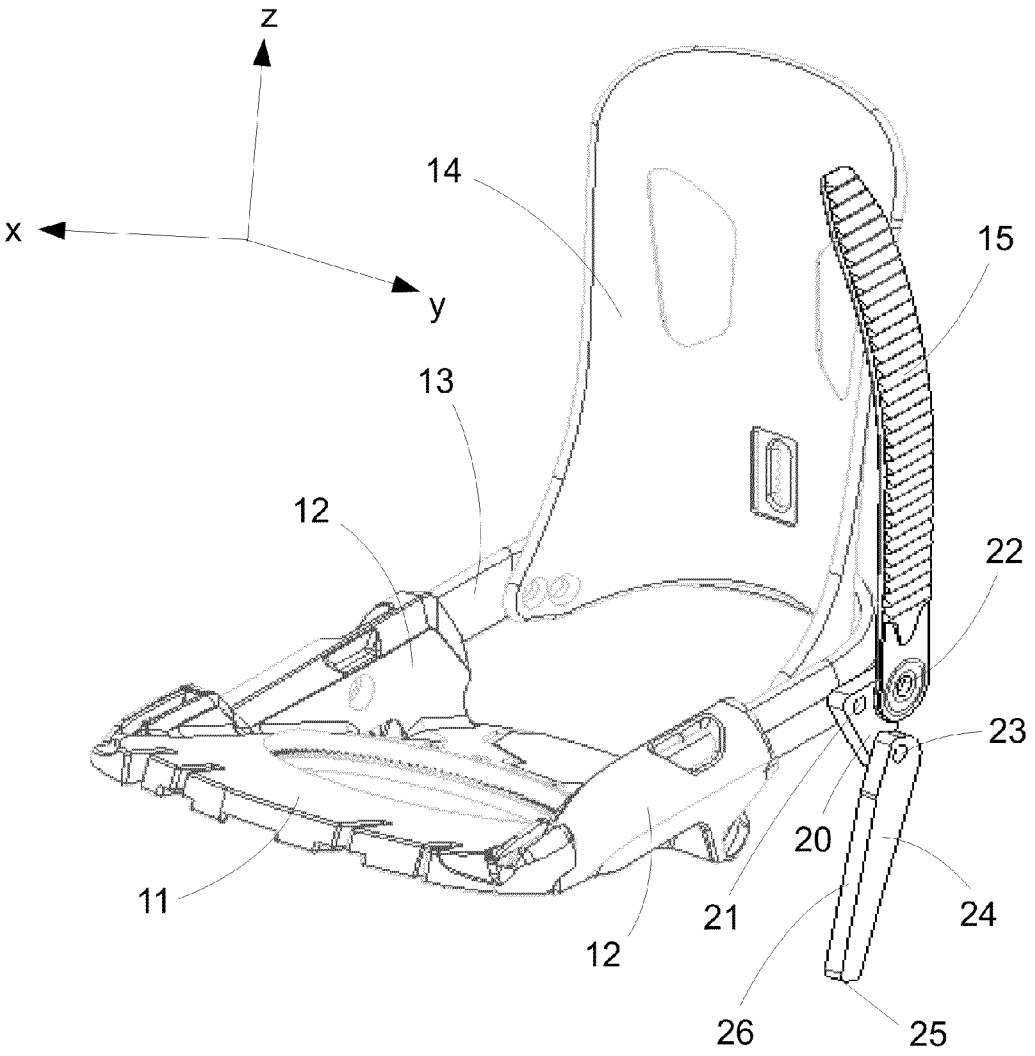
FIG. 2 shows a perspective view of a boot binding on a snowboard, comprising a braking device in the braking position, according to a first embodiment of the invention.
Figure 3:
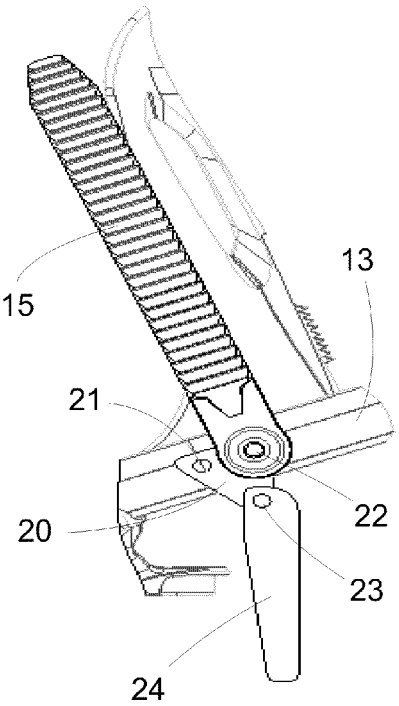
FIG. 3 shows a side view of the braking device in the braking position, according to the first embodiment of the invention.
Figure 4:
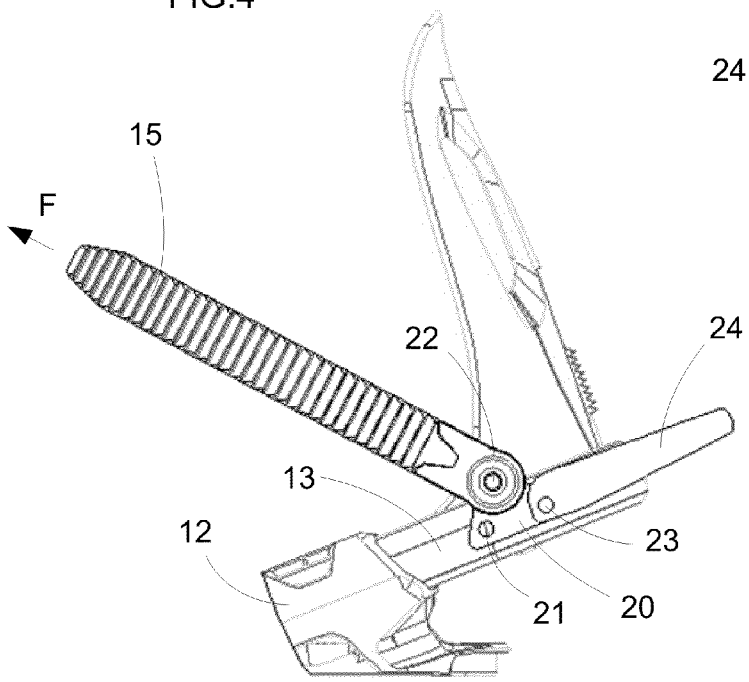
FIG. 4 shows a side view of the braking device in the non-braking position, according to the first embodiment of the invention.

FIGS. 2 to 4 illustrate a first embodiment of the invention in which the braking device is mounted on a boot binding on a snowboard. This boot-fastening device comprises, in a known manner, a base part 11 designed to receive the bearing force of the sole of a boot, two lateral wings 12 extended rearward by a bail 13 supporting a rear support element 14 designed to receive the rear bearing of the boot. For reasons of simplification, a single toothed part 15 of a rear boot-fastening strap is shown in the figures. However, the boot binding comprises two fastening straps similar to those of FIG. 1, each connected to a lateral wing or to the base part of the boot binding, only the toothed part 15 of which is shown, so as to fasten and tighten the top of a boot in the configuration in which the boot is fastened into the binding.

The braking device according to the first embodiment of the invention comprises a triangular base part 20 that is movable in the manner of a rocker, as will be explained below, which will simply be called "rocker", comprising, at a first angle, a link means 21 with the lateral part of the boot binding, at the second angle a link means 22 with the end of the boot-fastening strap 15, and at a third angle an elongate brake 24 fastened by a fastening means 23 to the rocker 20. The brake 24 has an end 25 designed to come into contact with the snow in order to fulfill a braking function, and also one or more, optionally toothed, lateral ridges 26 to enhance the braking function.

The functioning of the braking device will now be explained. FIGS. 2 and 3 show the boot binding in the configuration in which the boot is not fastened onto the snowboard, i.e. in the absence of a boot fastened into the device. In this configuration, the straps occupy a raised position, as illustrated by the rear strap 15, which has a substantially vertical orientation allowing the central space of the boot binding to be clear to facilitate the insertion of a boot. This raised position is obtained intentionally through the elastic effect of the material used for the strap, which naturally resumes its initial, rest position in the configuration in which the boot is not fastened into the device, or even by any other, different, elastic means.

FIG. 4 shows the device in the position in which the boot is fastened onto the snowboard. In the phase in which the boot is fastened onto the snowboard, the two strap parts, including the toothed part 15 shown, are brought closer together, over the top of a boot (not shown), in order to fasten one strap to the other and then to effect a tightening of the top surface of the boot, with the aid of a tightening buckle. In this operation, the strap 15 undergoes a forward rotation relative to the boot binding upon engagement of the toothed part in the tightening buckle, this operation positioning the strap in the buckle generally being called closure of the binding. Next, the tightening operation generates a significant traction force F on the strap, which holds the brake 24 in its non-braking position.

The rocker 20 of the braking device is mounted so as to be movable in rotation about its link pin 21 on the bail 13 of the boot binding, i.e. about a transverse axis substantially perpendicular to the wing 12 of the boot binding. A torsion spring (not shown) acts on this pin such that the brake tends toward being positioned in the braking position. Thus, in the absence of a boot in the binding, or even upon loosening and opening of the strap-tightening buckle over a boot, this spring gives rise to the automatic, stable positioning of the brake in the braking position. Conversely, fastening a boot onto the snowboard is accompanied by a rotation of the strap 15, as explained above, which gives rise to the rotation of the rocker 20 that then undergoes a rotation of a quarter turn about the pin 21, opposing the force of the spring. Thus, the strap 15 transmits a rotation moment to the rocker, which brings its link pin 22 from its initial position, to the rear of the rotation pin 21 substantially parallel to the bail 13, toward a position above said pin 21. This rotation gives rise at the same time to the rotation, through a quarter turn, of the brake 24 linked to the rocker 20, which enables it to be moved from its initial, substantially downward-oriented braking position, as illustrated in FIGS. 2 and 3, toward its non-braking position, substantially in line with the wing 12 or the bail 13, as shown in FIG. 4.

Figure 5:
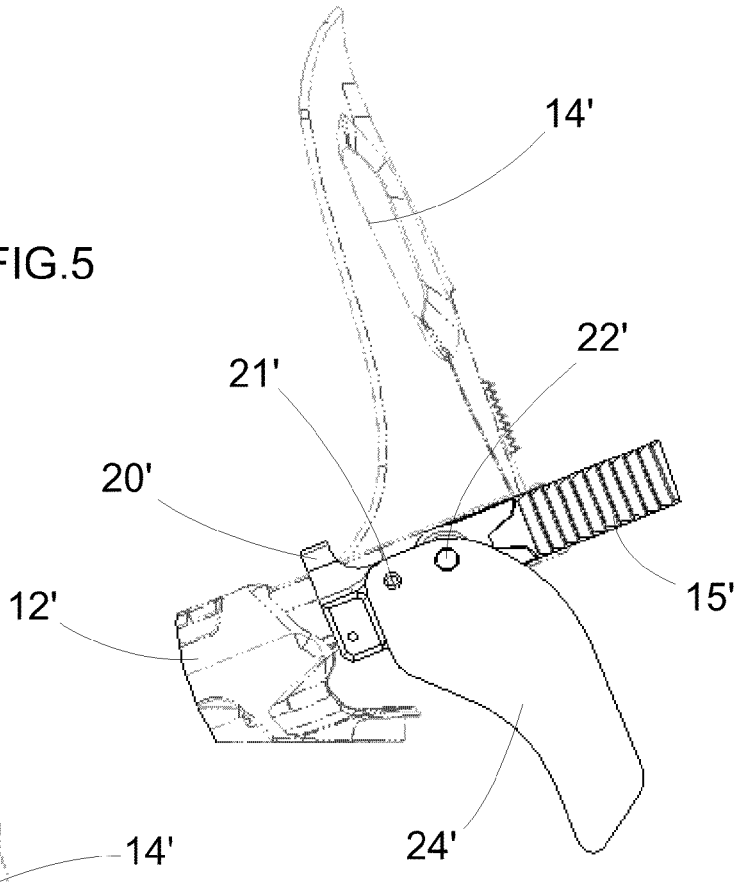
FIG. 5 shows a side view of the braking device in the braking position, according to a variant of the first embodiment of the invention.
Figure 6:
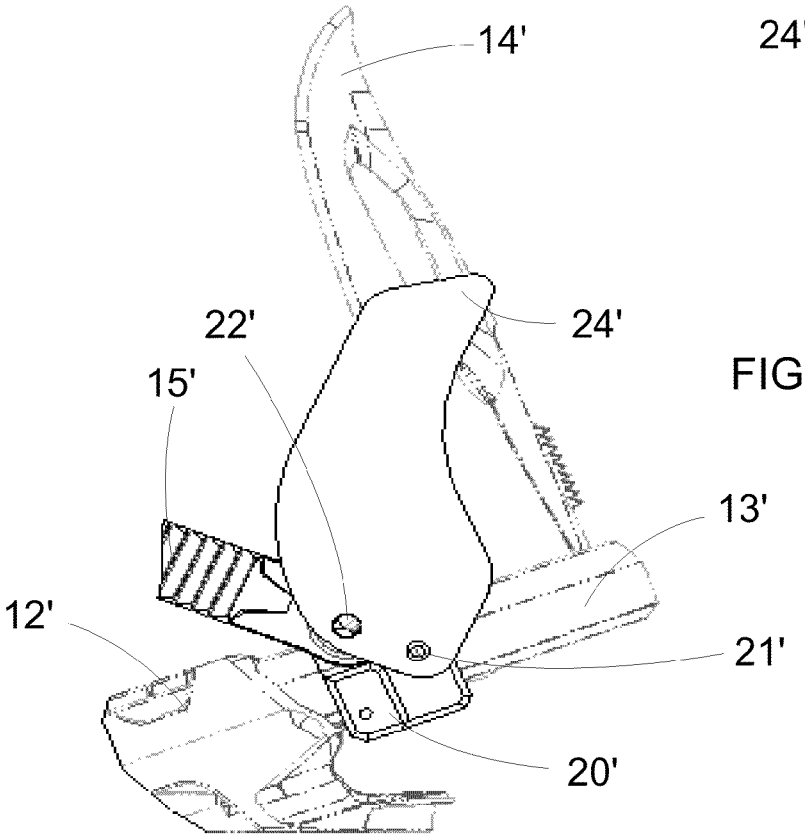
FIG. 6 shows a side view of the braking device in the non-braking position, according to the variant of the first embodiment of the invention.
Figure 7:
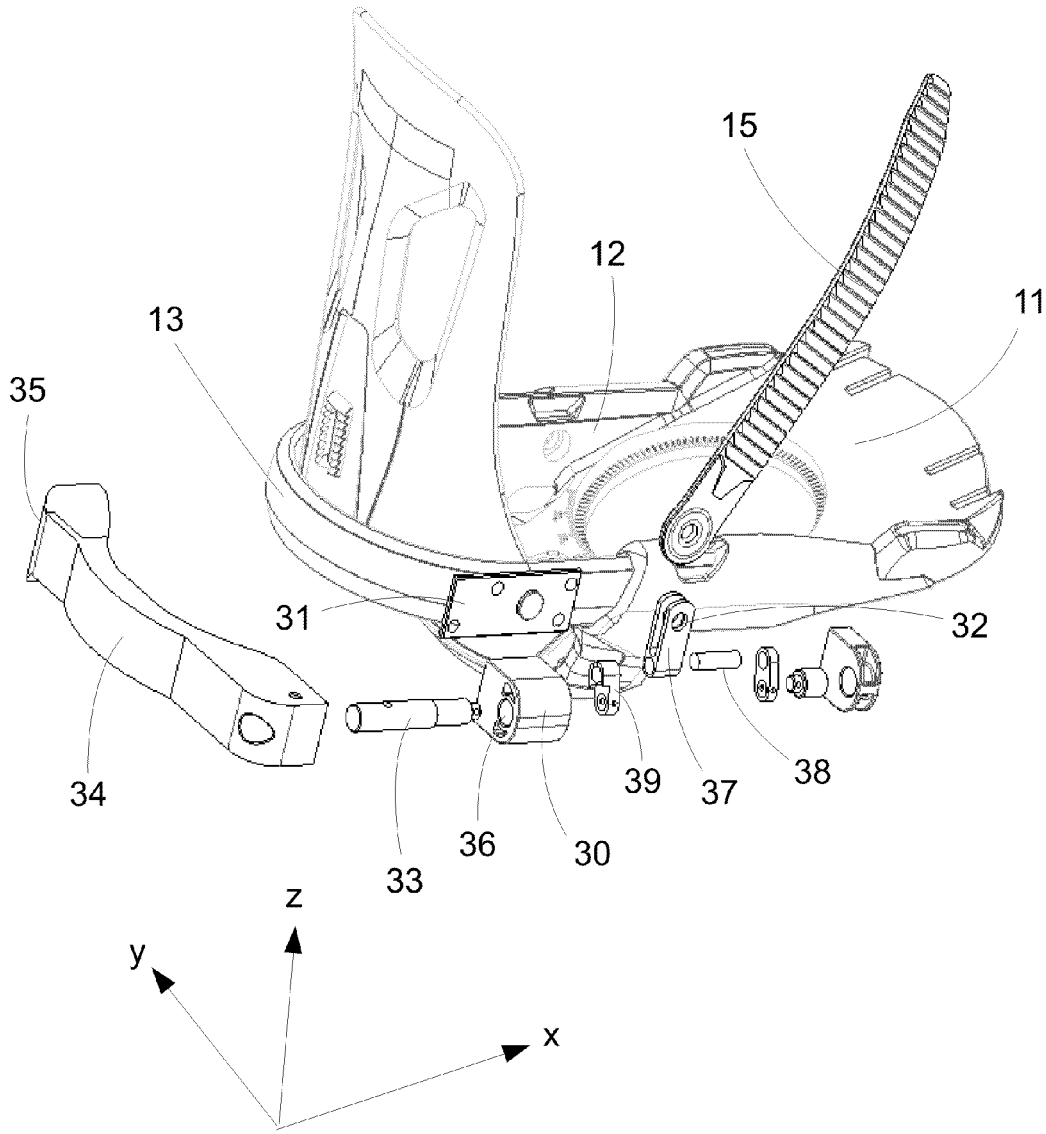
FIG. 7 shows a partially exploded perspective view of a boot binding on a snowboard, comprising a braking device in the non-braking position, according to a second embodiment of the invention.

FIGS. 5 and 6 illustrate a variant of this first embodiment, in which a rocker 20', still mounted so as to be movable in rotation about a pin 21' relative to the lateral bail 13' of the binding, has a slightly different shape and a different link with a strap 15' and a brake 24'. The passage from the braking position, illustrated in FIG. 5, to the non-braking position, illustrated in FIG. 6, is achieved by a rotation of practically one half turn of the rocker 20', allowing the positioning of the brake in the substantially vertical position, in line with a lateral side of the rear bearing element 14', in the non-braking position. This non-braking geometry enables the binding to be more compact and to achieve an attractive esthetic appearance. Naturally, the brake could occupy, in a variant embodiment, any position in which it is sufficiently raised in order no longer to come into contact with the ground when riding, and the rocker may exhibit any rotation movement through at least a quarter turn.

This first embodiment has been illustrated with a brake 24, 24' distinct from the rocker 20, 20'. In an equivalent variant embodiment, these two elements could form just a single piece. According to yet a further variant embodiment, the link between these two distinct elements could allow a respective mobility, between the passage from the braking position to the non-braking position.

In this first embodiment, the rocker has a means for control of the brake 24, 24'.

FIGS. 7 to 11 illustrate a second embodiment of the invention. In this second embodiment, a brake 34 remains linked to the rear strap 15 of the boot-fastening device, by means of a more complex control means comprising, in particular, a connecting rod 39.

The braking device of this second embodiment is also mounted at the bail 13 of the boot binding, at a wing 12. It comprises a base part 30 fastened to the bail 13 by means of a planar plate 31, which serves it as support. The base part 30 thus extends perpendicularly to the bail, in a substantially transverse direction y. It has a cylindrical opening 36 through which extends a pin 33 in a substantially longitudinal direction, connected, in its rear part, to the brake 34, and in its front part, to a connecting-rod-type mechanism. A link piece 37 comprises a first end linked to the lower part of the strap 15, via a link 32 allowing it a rotation, and a second end linked to a pin 38, itself connected to a first end of a connecting rod 39. The second end of the connecting rod 39 is connected to the pin 33 of the brake 34. The latter is subject to a return force by a torsion spring (not shown) arranged between the base part 30 and the pin 33, which tends to position the brake in the braking position. Incidentally, to improve the reliability and robustness of the mechanism, the connecting-rod function is in fact fulfilled by two parallel connecting rods 39, 39' arranged at the ends of the intermediate pin 38.

The functioning of this braking device will now be explained. FIGS. 8 and 9 show this device in the non-braking position, in which the brake 34 occupies a substantially horizontal position in the transverse direction y, arranged to the rear of the bail 13 of the boot binding. The latter is in its configuration in which a boot is fastened onto the snowboard (not shown), in which its strap 15 tightens the top of the boot in order to ensure it is held. The strap is thus subject to a traction force in this configuration in which the boot is fastened onto the snowboard, as was explained previously, which positions the link piece 37 in a raised configuration, giving rise to the rotation of the connecting rod 39 in a practically vertical, raised position, by means of its pin 38, as may particularly be seen in FIG. 9. When the strap is released from being held by the tightening buckle, the torsion spring automatically returns the entire mechanism into the braking position and holds it in this position.

FIGS. 10 and 11 illustrate the same braking device in its braking position. When the boot-tightening strap 15 is released, when a boot is released from its binding, it resumes its rest configuration in which it is no longer subject to a vertical traction force. The connecting rod 39 then resumes its rest position, through the effect of a return spring, via a rotation of approximately a quarter turn. In this position, the link piece 37 occupies a low position. This change in the position of the connecting rod 39 gives rise to the rotation of the pin 33 by a quarter turn, which positions the brake 34 in the downward-oriented substantially vertical braking position, in which its end 35 is able to enter into frictional engagement with the snow in order to fulfill the function of braking a board for gliding.

In this embodiment, the mechanism for controlling the position of the brake 34 on the basis of at least one connecting rod 39 enables the translational movement of the strap 15 between its two configurations—with the boot fastened onto the snowboard and with the boot not fastened onto the snowboard, respectively—to be converted in order to transmit a rotation movement of a quarter turn to a substantially longitudinal pin 33 parallel to the plane of the lateral wing 12 of the boot binding. The brake is thus movable in rotation about a longitudinal axis in this second embodiment of the invention.

FIGS. 12 to 15 illustrate a third embodiment of the invention, in which a braking device is independent of the boot binding but is still connected to a strap of the boot binding on a snowboard.

The braking device comprises a brake 44 mounted in rotation by means of a pin 43 arranged on a vertical base piece 40 fastened on a plate 10 linking to a snowboard at the rear part of a boot binding and in the vicinity of the outer perimeter of the snowboard in order to make it possible for the brake to be able to extend beyond the edge of the snowboard in the braking position. In a variant embodiment, the braking device could be mounted directly on the top face of a snowboard, in the absence of a plate 10. The braking device furthermore comprises a wheel 45 integral with the rotation pin 43, arranged to the side of the brake 44. This wheel 45 is connected by a cable 46, protected by a sheath, to a rear strap 15 of the boot binding. At the end of the strap 15, the braking device comprises a base part 47, with lateral slide ways 48, fastened to the rear bail 13 of the boot binding via a fastening means 41. These lateral slide ways 48 guide a plate 49 that is movable in translation within this base part 47. A wheel 50, about which is wound the cable 46, the end of which is fastened toward a lower end of the base part 47, is fastened to the lower end of this plate 49. The lower end of the strap 15 is linked by a link means 42 to the upper part of this plate 49.

The functioning of this braking device will now be explained.

Figure 12:
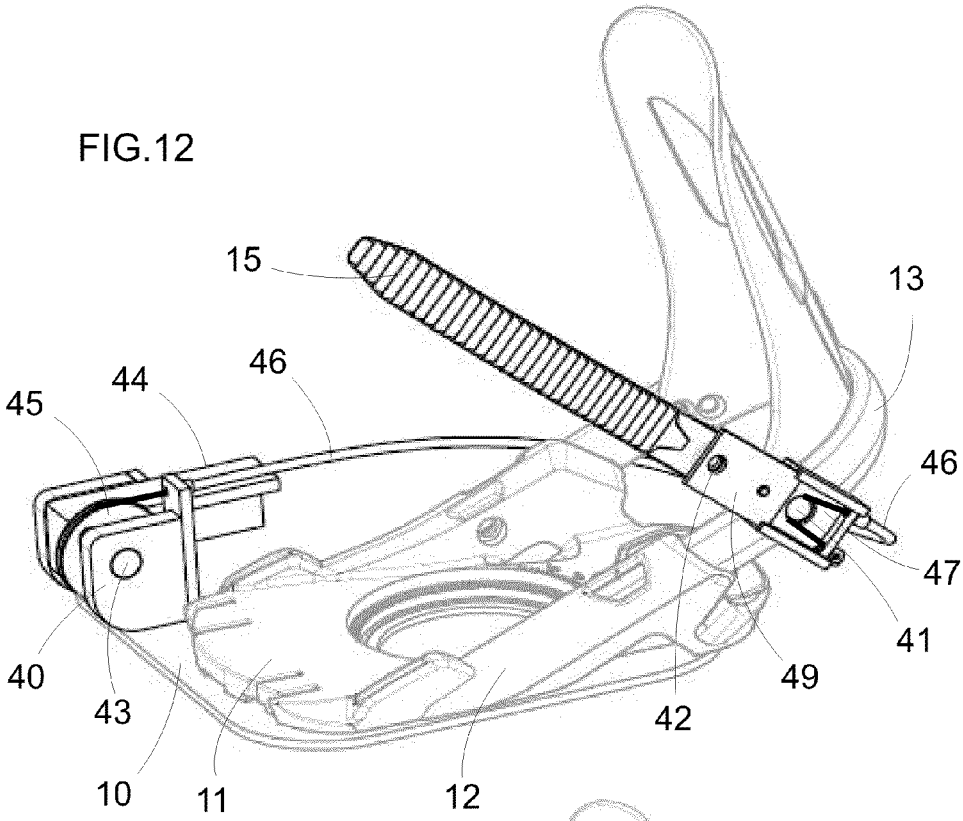
FIG. 12 shows a side perspective view of a boot binding on a snowboard, comprising a braking device in the non-braking position, according to a third embodiment of the invention.
Figure 13:
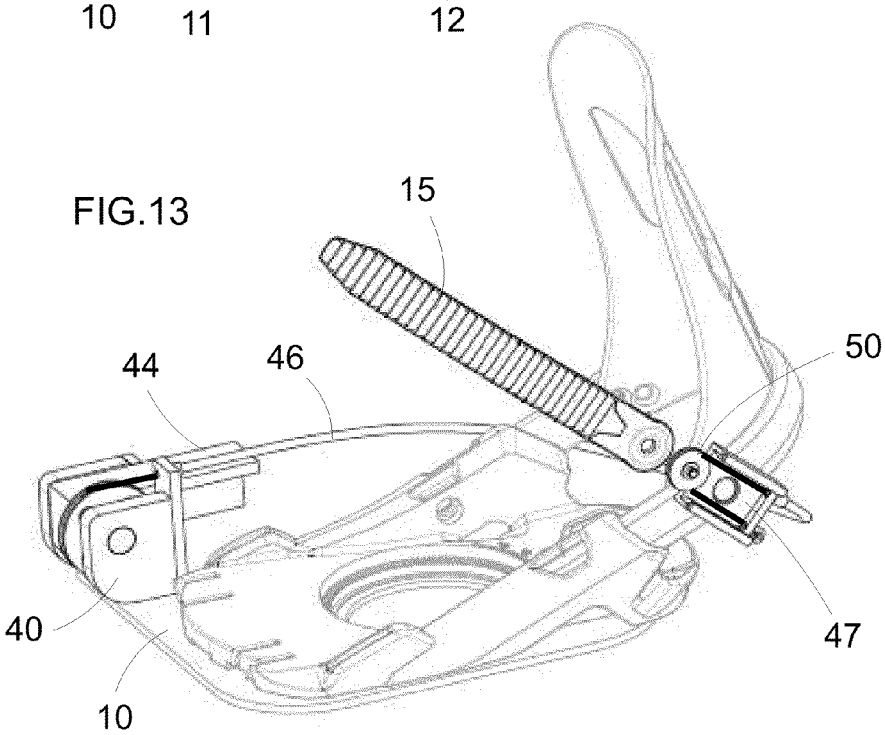
FIG. 13 shows a partial side perspective view of the boot binding on a snowboard, comprising a braking device in the non-braking position, according to the third embodiment of the invention.
Figure 14:
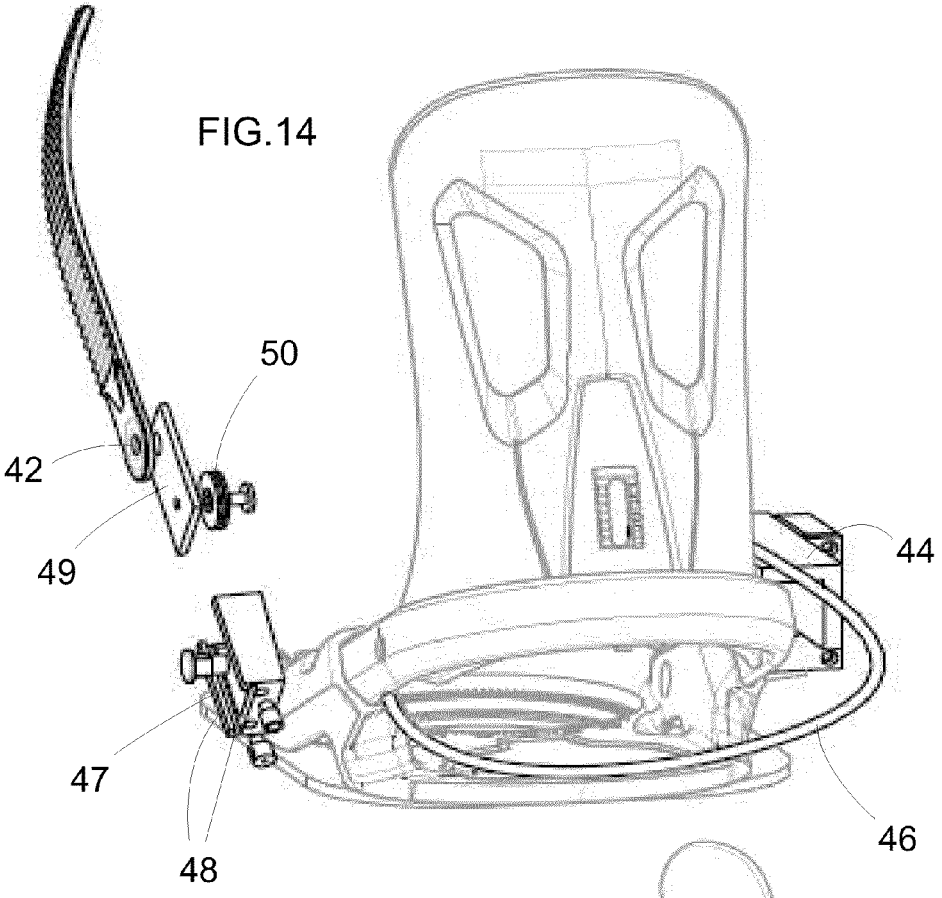
FIG. 14 shows a partially exploded rear perspective view of the boot binding on a snowboard, comprising a braking device according to the third embodiment of the invention.
Figure 15:
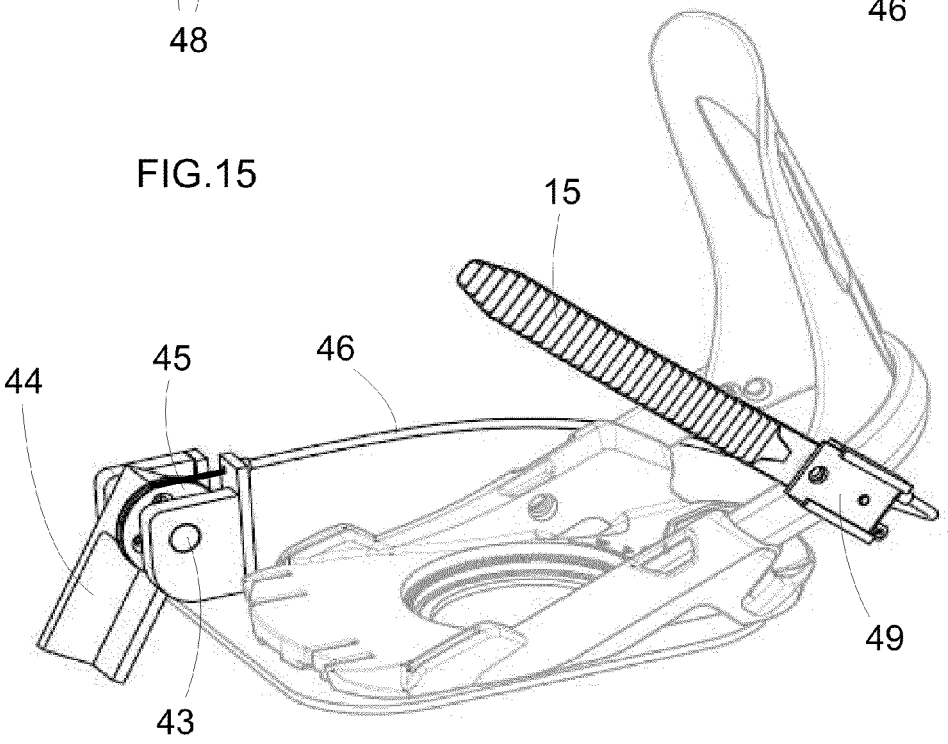
FIG. 15 shows a side perspective view of the boot binding on a snowboard, comprising a braking device in the braking position, according to a third embodiment of the invention.

FIGS. 12 and 13 show the brake 44 in the non-braking position, corresponding to the position of the strap 15 in the configuration of tightening a sports boot (not shown). In this configuration, a traction force is exerted on the strap 15, which leads to the positioning of the movable plate 49 in the high position. This high position gives rise to a traction on the cable 46, which is transmitted to the wheel 45 in order to hold the brake 44 in its non-braking position. Upon release of a boot, the strap 15 is released from its force and likewise releases the force exerted on the cable 46. The wheel 45 is then free to perform a rotation through the effect of a return spring (not shown), which rotate the pin 43 and thus the integral brake 44 in its braking position, shown in FIG. 15. The amplitude of this rotation is approximately three quarters of a turn. In this braking position, the plate 49 occupies its low position within the slide ways 48. This plate entrains the cable 46 abut the wheel 50, which has the function of amplifying the displacement of the strap 15 between the two configurations it occupies, in order to transmit a greater amplitude of movement to the cable 46. The wheel 50 also makes it possible to prevent friction during these movements. In a variant embodiment, the cable could be mounted on the base part 47 without using an intermediate wheel 50.

Conversely, the fastening of a boot into the binding will give rise to the automatic repositioning of the brake 44 in the non-braking position, through the sole effect of the traction on the strap 15 during the fastening thereof over the boot, the cable 46 transmitting this force to the wheel 45, the diameter of which is determined in order to enable it to exert a moment sufficient to set the rotation pin 43 in movement against the inverse force exerted by the return spring.

In this third embodiment, the control means of the brake 44 thus essentially comprises a cable 46 and, accessorily, at the strap 15, a plate 49 that can move in translation in slide ways 48, and at the brake 44 a wheel 45 integral with the rotation pin of the brake.

The concept of the invention, as implemented by the embodiments described above, makes it possible to obtain a braking device that has the following advantages:

It makes it possible, very simply, to link the movement of the brake to the displacement of a boot-fastening strap between its two configurations of fastening and non-fastening of a boot, without the need for manipulation in addition to the customary manipulations of the boot binding in order to attach and to release a boot;

It allows the automatic passage from the braking position to the non-braking position, and vice versa, which results in very user-friendly functioning since there is no need for the specific additional manual intervention of a user;

It is simple and is compact; and

It is adapted to an existing boot binding and can even be added to devices already mounted on boards for gliding that are not equipped with a braking device. To that end, the braking device may take the form of a braking kit to be mounted on a board for gliding and to be connected to a boot binding. The member for controlling the brake may simply and easily be mounted at the existing location where a strap is secured to the base part or to a lateral wing.

In the case of snowboards, the braking device has been adapted for a snowboard equipped with a strap-type boot binding, as illustrated and described. However, the invention is still compatible with a different binding, of the step-in type. It suffices in this case to add a strap, the function of which would essentially be to perform the braking function. Furthermore, it has been illustrated in the case of a boot binding that has a base part, two lateral wings and a separate rear bail. It naturally still applies to other binding configurations, particularly if the wing and the rear bail form a single monolithic element, for example.

Naturally, the invention is not limited to the embodiments described. In particular, any control means could be implemented in order to link the movement of the brake to the restricted movement of a boot-fastening strap of a binding device, allowing automatic passage from the braking position of the brake to the non-braking position. The control has been illustrated as involving a brake in rotation, through a rotation of one quarter or of two or three quarters of a turn. As a variant embodiment, this rotation may have other values, and the movement of the brake could even be other than a rotation. In the embodiments described, the control of the brake for the passage thereof from the braking position to the non-braking position is advantageously achieved by a traction force exerted upon entry of the control means, after the traction exerted on a fastening strap when the boot is fastened onto a snowboard. In a variant embodiment, however, the mechanism could be reversed, a thrust force, not a traction force, then giving rise to this passage of the brake from its braking position to its non-braking position.

Furthermore, the brake may take any form other than those illustrated by way of example and may be made from various materials, for example a rigid plastic and/or from metal. The braking device may be linked to the front strap or any binding element, band or strap. Lastly, the braking device has been illustrated within the context of an implementation on a snowboard. It could also be used for any other board for gliding—ski, snowshoe, etc. A single braking device may be arranged on a board for gliding, linking with a single one of the two boot bindings, for example that relating to the front foot in the case of snowboards, to allow release of the rear foot for "scooting", at certain times when the slope is insufficient for gliding. In a variant embodiment, a number of braking devices may be envisaged for one and the same board for gliding.

The invention claimed is:

1. A sports boot binding on a board for gliding, comprising:

at least one boot-fastening strap, able to fasten and tighten the top of a sport boot into the binding on a board for gliding;

a base part, two lateral wings extended rearward by a bail, and a braking device comprising:

a brake movable between a braking position, in which the brake occupies a low position wherein the brake is in frictional contact with the ground, and a non-braking position, in which the brake occupies a raised position not in frictional contact with the ground, and a brake control device connecting the brake to one strap of a boot binding, such that the brake control device causes the brake to move from the braking position to the non-braking position upon closing and/or tightening of the at least one strap of the boot binding, wherein the brake control device comprises a link piece movably mounted to the base part, or to one of the lateral wings or to the bail; the strap being mounted on said link piece.

2. The sports boot binding on a board for gliding as claimed in claim 1, wherein the brake control device is linked to the at least one strap of the boot binding, such that the brake control device causes movement of the brake to the non-braking position upon closure and tightening of the at least one strap on a boot disposed in the sports binding and the brake control device causes movement of the brake to the braking position upon opening of the strap for release of the boot through the force of a return spring.

3. The sports boot binding on a board for gliding as claimed in claim 1, wherein the link piece is a rocker mounted in rotation on one of the lateral wings or the bail of the boot binding about a pin; the end of the at least one boot-fastening strap being mounted on the rocker by a second pin positioned behind the rotation pin of the rocker, and wherein the brake is mounted securely on the rocker and is movable in rotation about a transverse pin relative to the boot binding.

4. The sports boot binding on a board for gliding as claimed in claim 1, wherein the brake control device comprises at least one fastening strap and a second end of which is linked to a rotation pin of the brake, the rotation pin being movable in rotation within a rocker in a substantially longitudinal direction relative to the boot binding.

5. The sports boot binding on a board for gliding as claimed in claim 1, wherein the brake is movable in a rotational movement of approximately a quarter turn between the braking position and the non-braking position.

6. The sports boot binding on a board for gliding as claimed in claim 1, wherein the link piece is a plate linked to the end of at least one fastening strap and movable in translation relative to the base part of the boot binding, the brake control device comprising a cable connected, on the one hand, to a rotation pin of the brake mounted in rotation on a base piece, and, on the other, to the plate.

7. The sports boot binding on a board for gliding as claimed in claim 1, wherein the brake is mechanically coupled to the brake control device.

8. The sports boot binding on a board for gliding as claimed in claim 1, wherein the brake is mounted to the brake control device.

9. The sports boot binding on a board for gliding as claimed in claim 1, wherein the link piece is movable around a transversal axis mounted on the base part, or on one of the lateral wings, or on the bail.

10. The sports boot binding on a board for gliding as claimed in claim 1, wherein the link piece is movable around a longitudinal axis mounted on the base part, or on one of the lateral wings, or on the bail.

11. The sports boot binding on a board for gliding as claimed in claim 1, wherein the brake control device comprises at least one connecting rod, a first end of the connecting rod is a link with the at least one strap of the boot binding and a second end of the connecting rod is linked to a rotation pin of the brake.

12. The sports boot binding on a board for gliding as claimed in claim 3, wherein, in a configuration in which the boot is fastened to the board for gliding, the brake occupies a position substantially parallel to a bail or wing, or wherein the brake is substantially parallel to a lateral side of a rear support element.

13. The sports boot binding on a board for gliding as claimed in claim 3, wherein a tightening effort on the at least one strap causes the rotation of the link piece, which acts on the brake to hold the brake in the non-braking position.

14. The sports boot binding on a board for gliding as claimed in claim 11, wherein a tightening effort on the at least one strap strap causes the rotation of the link piece, which acts on the brake to hold the brake in the non-braking position.

15. The sports boot binding on a board for gliding as claimed in claim 6, wherein a tightening effort on the at least one strap causes the translation of the link piece, which acts on the brake to hold the brake in the non-braking position.

* * * * *